US005417341A

United States Patent [19]

Petriekis et al.

[11] Patent Number: 5,417,341

[45] Date of Patent: May 23, 1995

[54] BOX AND A PACKAGING SYSTEM FOR CONTAINING ELONGATE FRAGILE OBJECTS

[75] Inventors: Paul F. Petriekis, Palos Park, Ill.; John Gruber, Caledonia, Mich.; Joe Hall, Geneva, Ill.; John H. Schwan, Palatine, Ill.; Robert A. Van Beek, Paw Paw, Ill.; James Zavodsky, Schaumburg, Ill.

[73] Assignee: Packaging Systems, Inc., Westmont, Ill.

[21] Appl. No.: 45,911

[22] Filed: Apr. 12, 1993

[51] Int. Cl.[6] ..... B65D 90/04

[52] U.S. Cl. ..... 220/403; 206/495; 220/462; 229/115

[58] Field of Search ..... 229/115; 206/495, 521, 206/583, 334; 220/462, 463, 403, 408, 410, 416

[56] References Cited

U.S. PATENT DOCUMENTS

| | | | |
|---|---|---|---|
| 1,897,143 | 2/1933 | Powell | 229/115 X |
| 3,199,765 | 8/1965 | Locke | 229/115 X |
| 3,387,764 | 6/1968 | Forrest | 220/462 X |
| 3,416,717 | 12/1968 | Beck, Jr. et al. | 220/462 |
| 3,578,234 | 5/1971 | Marchisen | 220/462 |
| 3,606,230 | 9/1971 | Hargreaves | 224/309 X |
| 3,853,220 | 12/1974 | Luray | 206/583 X |
| 4,606,459 | 8/1986 | Luray | 206/583 |
| 4,734,288 | 3/1988 | Engstrom | 220/462 X |
| 5,178,396 | 1/1993 | Lyon et al. | 229/115 X |
| 5,226,542 | 7/1993 | Boecker et al. | 206/583 |

*Primary Examiner*—Allan N. Shoap
*Assistant Examiner*—Christopher J. McDonald
*Attorney, Agent, or Firm*—Wallenstein & Wagner, Ltd.

[57] ABSTRACT

The present invention comprises a packaging system 100 for a product 58 having an envelope 50 with a pouch 52 adapted to securely retain the product 58, the envelope 50 having a tail portion 54 extending away from the pouch 52, and a blank 10 having a leading 16 and a trailing portion 20, the blank 10 may be folded about the envelope 50 such that the tail portion 54 is trapped between the leading portion 16 and the trailing portion 20 of the blank 10.

17 Claims, 2 Drawing Sheets

BOX AND A PACKAGING SYSTEM FOR CONTAINING ELONGATE FRAGILE OBJECTS

BACKGROUND OF THE INVENTION

The use of window blinds including venetian blinds, mini blinds, micro blinds, and other foldable blinds have become increasingly popular as window treatments in homes, apartments, and in commercial office spaces. Notwithstanding the increasing popularity of these blinds, to date no one has offered a satisfactory way of shipping the blinds or like elongate fragile products. Typically these blinds, along with the accompanying hardware to hang the blinds, are wrapped together or separate in bubble wrap or like material, and then shipped in an elongate box.

This method of shipment is deficient in several respects. First, often times the blinds are damaged in shipment because the box creases and folds along the length of the box or crushes at its ends thereby allowing the blinds to do the same. Second, in order to inspect the blinds that have been shipped to see if they are the correct color or if they have the proper hardware, one must not only open the box but must also unwrap the bubble wrap. This is a time consuming process especially if one is installing blinds, say in a high-rise complex, where many shipments of blinds have arrived in various sizes and colors. Not only is it time consuming process but this practice also leads to additional damage to the blinds when they are improperly packaged and sent back to the manufacturer or distributor.

SUMMARY OF THE INVENTION

It is an object of the present invention to provide a box and a packaging system for elongate fragile products such as window blinds that allow for safe shipment of the product while at the same time providing a package that is easy to unwrap and whose contents may be easily inspected.

The present invention provides a packaging system for a product consisting of an envelope that securely retains the product and a blank that may be folded about the envelope for shipment. The envelope has a tail portion extending away from the pouch. The blank has a leading and a trailing portion such that when the blank is folded about the envelope the tail portion of the envelope is trapped between the leading and trailing portion of the blank. This arrangement allows the envelope to be secured within the box to prevent both lateral and longitudinal movement of the envelope within the box. This reduces the chance that the product will be damaged during shipment.

Preferably, the blank has opposed lateral sides and four latitudinal fold lines extending therebetween to define first, second, third, fourth and fifth panels. The blank may be folded about the fold lines to form a triangular shaped box having two of its legs formed by overlapping panels. That is, two of the walls have double thickness along the entire length of the box thereby increasing the strength of the box along its length dimension. This reduces the chances that the product will fold and damage the product inside the box.

The envelope of the present invention is preferably constructed using a backing substrate and an essentially transparent cover sheet. The cover sheet overlaps and is attached to the backing substrate using a pressure sensitive adhesive. The product is securely retained between the backing substrate and the cover sheet. Because the cover sheet is essentially transparent, the product may be inspected without unwrapping the envelope.

It is also desirable to vent the envelope by puncturing holes in the transparent cover sheet or the backing substrate so that air may be evacuated from the envelope for ease of packaging. Further, either the backing substrate or the cover sheet should be provided with means for separating the backing substrate from the cover sheet.

DETAILED DESCRIPTION

Figure 1:
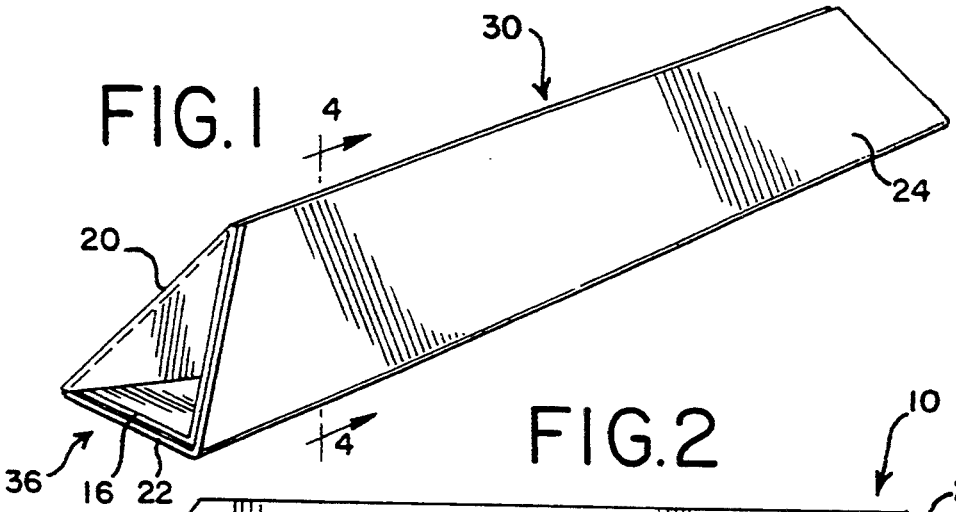
FIG. 1 is a perspective view of the box of the present invention constructed from the blank of FIG. 2.
Figure 2:
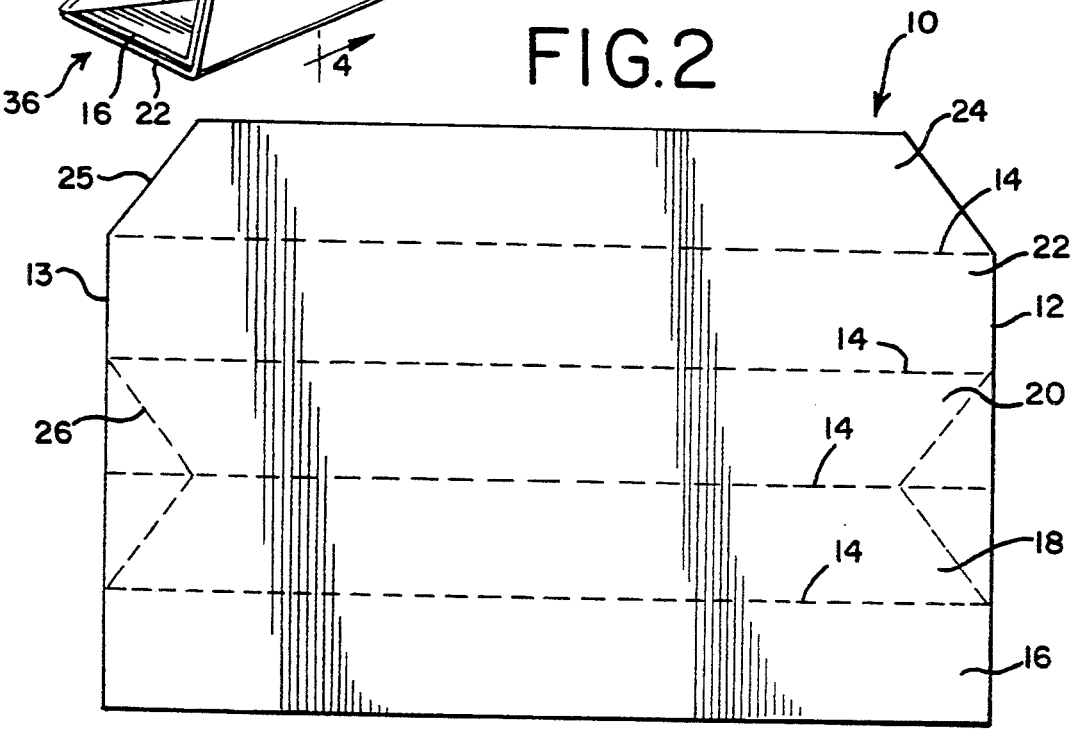
FIG. 2 is a plan view of the elongate corrugated paper blank of the present invention.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

FIG. 1 shows an elongate blank 10 having opposed first and second lateral sides 12 and 13, having four latitudinal fold lines 14 extending therebetween to define first, second, third, fourth, and fifth panels, respectively designated 16, 18, 20, 22, and 24. Triangular shaped fold lines 26 are provided at each lateral side 12 and 13 of the blank 10 at the second and third panels 18 and 20. Also, a portion of the fifth panel 24 has portions removed at each lateral edge of the blank to form recesses 25. The blank 10 is made of corrugate paper and has fold lines formed by creasing the corrugated paper as is standard practice in the industry.

Figure 3:
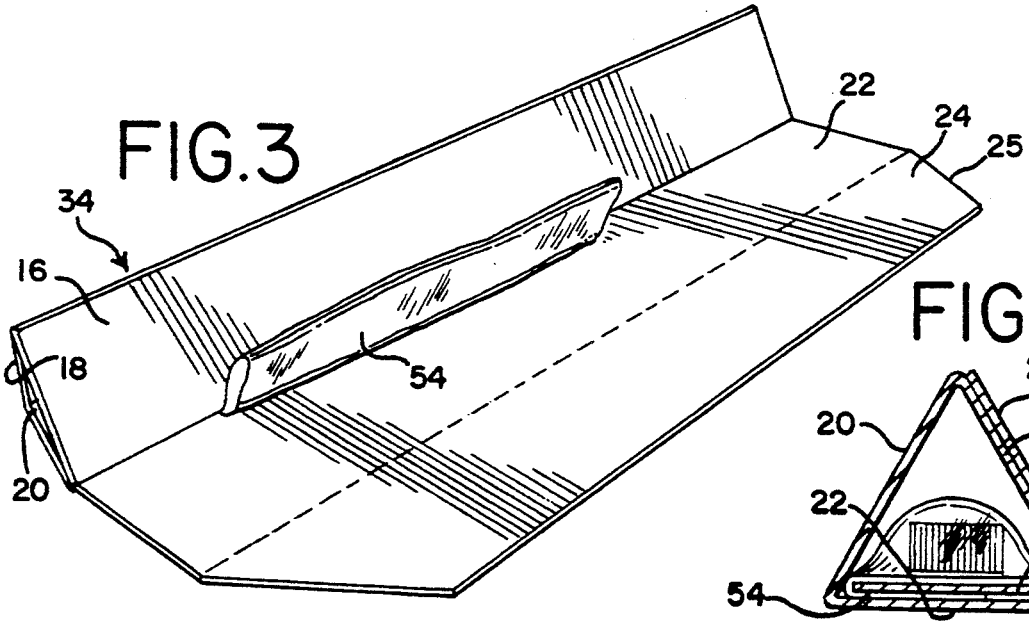
FIG. 3 is an end view of the envelope enclosed within a triangular sleeve formed from partially folding the blank.
Figure 4:
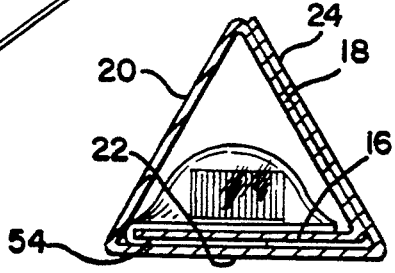
FIG. 4 is an end view of FIG. 1 taken along line 4—4 showing the envelope enclosed therein.

FIG. 1 shows the box 30 formed from folding blank 10 along the latitudinal fold lines 14 and the triangular shaped fold lines 26. The box 30 is constructed by first folding the first and second panels 16 and 18 inward of the blank 10 until an end 32 of the first panel 16, the leading portion, contacts the third panel 20, trailing portion, to define a triangular shaped sleeve 34 (FIG. 3). The third and fourth panels 22 and 24 are folded inward toward the triangular sleeve 34 such that the fourth panel 22 overlaps the first panel 16 and the fifth panel 24 overlaps the second panel 18 (FIG. 4). The fifth panel 24 is attached to the blank 10 using tape or an adhesive. The recesses 25 of the fifth panel 24 allows the fifth panel to conform to the shape of the triangular sleeve 34. The triangular sleeve 30 is closed at each end by folding the blank 10 along the triangular shaped fold lines 26 to form inwardly extending tetrahedron shaped end closures 36. Such end closures 36 form a buffer zone that absorbs the shock if the box is dropped on its end to prevent damaging the contents of the box 30.

FIG. 4 shows the overlapping relationship of the first and fourth panels 16 and 22 and the second and fifth panels 18 and 24. This arrangement provides for greater support along the length dimension of the box 30. However, it is conceivable that these overlapping panels, fourth and fifth 22 and 24, could be done without and the box could be sealed by attaching the first panel 16 to the third panel 20.

Figure 5:
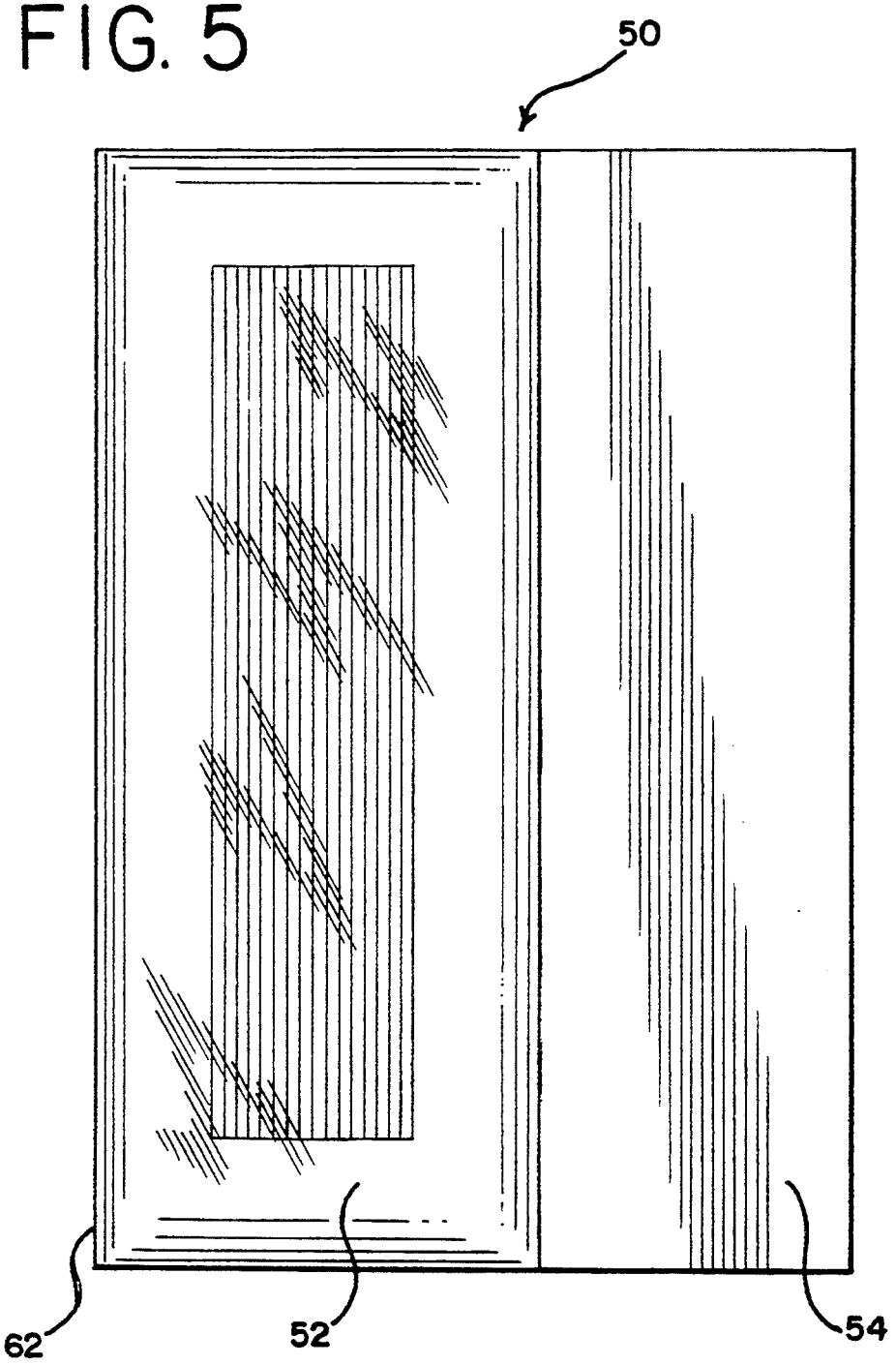
FIG. 5 is a plan view of the envelope with a product securely retained therein.
Figure 6:
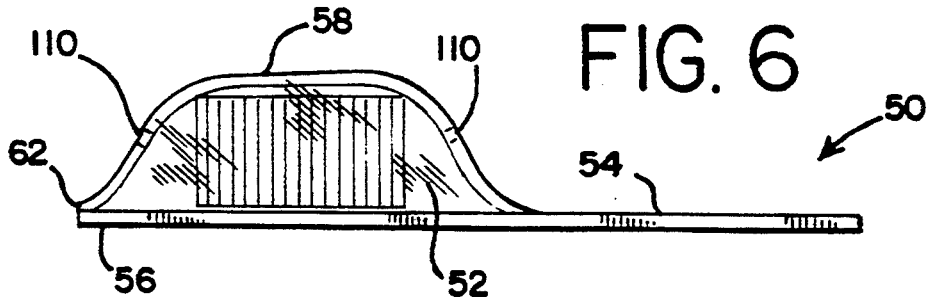
FIG. 6 is a side view of the envelope with a product securely retained therein.

FIGS. 5 and 6 shows an envelope 50 having a pouch portion 52 securely retaining a product 53 and a tail portion 54 extending away from the pouch 52. As will be discussed below, the tail portion 54 secures the envelope inside the box 30 to prevent both lateral and longitudinal movement of the envelope within the box 30. (FIG. 3) The envelope 50 is constructed from a backing substrate 56 and an essentially transparent cover sheet 58 placed over the backing substrate 56 in overlapping relationship and attached to the backing substrate 56 using a pressure sensitive adhesive. The backing substrate is preferably made of a heavy weight paper sold by Kraft ®. The cover sheet 58 is preferably a polyolefin such as polypropylene. Of course it would be possible to use Kraft ® paper as both backing substrate and cover material; however, you would lose the advantage of the transparency of the plastic cover sheet.

A portion of the cover sheet 58 extends beyond a lateral edge 60 of the backing substrate 56 to form a tab 62. Preferably, the tab 62 runs along essentially the entire lateral edge 60 of the backing substrate 56. However, it could be made much smaller to reduce material costs. The tab 62 provides a gripping surface to peel apart and separate the backing substrate 56 from the cover sheet 58 to unpack the product 58. The tab could also be integral with the backing substrate 56 or could be a separate piece of material attached to either the backing substrate 56 or the cover sheet 58.

The envelope 50 when used in conjunction with the box 30 forms the packaging system 100 of the present invention. As shown in FIGS. 3 and 4, the blank 10 is folded about the envelope 50 so that the blank 10 traps the tail portion 54 of the envelope 50 between the first and third panels 16 and 20. The fourth and fifth panels 22 and 24 are then folded inward to further trap the tail portion 54 between the fourth panel 22 and the first panel 16. The envelope is thereby retained in position inside the box 30 to prevent movement inside the box either laterally or longitudinally. Depending on the dimensions of the product, several of these envelopes 50 may be enclosed in a single box 30.

It is desirable that portions of the cover sheet 58 have vents 110 punctured therethrough to allow for the passage of air. This allows excess air to be evacuated from the envelope 50 during packaging.

While the specific embodiments have been illustrated and described, numerous modifications come to mind without significantly departing from the spirit of the invention and the scope of protection is only limited by the scope of the accompanying claims.

We claim:

1. A packaging system for a product comprising:

an envelope having a pouch adapted to securely retain the product, the envelope having a tail portion extending away from the pouch; and, a blank having a leading portion and at least three contiguous panels defined by at least two fold lines, the blank being folded along the fold lines about the envelope with the leading portion engaging the tail against one of the panels.

2. The system of claim 1 wherein the blank has first, second, third, fourth, and fifth contiguous panels and first, second, third and fourth fold lines, wherein the contiguous panels are hingedly connected along the fold lines.

3. The system of claim 2 wherein the blank is folded along the fold lines to define a triangular sleeve having first, second, and third walls, wherein the tail is secured between the first and fourth contiguous panels.

4. The system of claim 3 wherein the pouch includes:

a backing substrate; and, an essentially transparent cover sheet overlaying a portion of the backing substrate and attached thereto.

5. The system of claim 4 wherein the tail portion is integral with the backing substrate.

6. The system of claim 5 wherein the pouch includes a means for separating the backing substrate from the transparent cover sheet.

7. The system of claim 6 wherein the means for separating the backing substrate from the cover sheet includes a tab.

8. The system of claim 7 wherein the tab is integral with the cover sheet and extends beyond a lateral side of the backing paper.

9. The system of claim 8 wherein the transparent cover has a portion removed in the pouch to define a hole which allows for the passage of air therethrough.

10. The system of claim 9 wherein the blank is made of corrugated paper.

11. The system of claim 10 wherein the cover sheet is made of polypropylene.

12. A packaging system for a product comprising:

a backing substrate;

an essentially transparent cover sheet overlapping a portion of the backing substrate and being attached thereto to define a pouch, the pouch being adapted to securely retain the product;

a tail attached to the pouch; and, an elongate blank having a leading portion, opposed lateral sides and four latitudinal fold lines to define first, second, third, fourth, and fifth contiguous panels, the blank being folded along the fold lines about the envelope with the leading portion engaging the tail against one of the panels.

13. The system of claim 12 wherein the blank is capable of folding along the fold lines about the pouch to define a triangular shaped box wherein the tail is secured between the first and third contiguous panels.

14. The system of claim 12 wherein the tail is attached to the backing substrate.

15. The system of claim 12 wherein the cover sheet has a portion removed to define a vent to allow for the passage of air therethrough.

16. The system of claim 12 wherein the pouch includes a means for separating the backing substrate from the cover sheet.

17. The system of claim 16 wherein the means for separating includes a tab connected to the cover sheet.

* * * * *

UNITED STATES PATENT AND TRADEMARK OFFICE

CERTIFICATE OF CORRECTION

PATENT NO. : 5,417,341

DATED : May 23, 1995

INVENTOR(S) : Paul F. Petriekis et al.

It is certified that error appears in the above-indentified patent and that said Letters Patent is hereby corrected as shown below:

Column 1, line 30, delete "packaged" and insert --repackaged-- therefor.

Signed and Sealed this

Twelfth Day of September, 1995

*Attest:*

Bruce Lehman

BRUCE LEHMAN

*Attesting Officer*

*Commissioner of Patents and Trademarks*